US008890779B2

(12) United States Patent
Lee et al.

(10) Patent No.: US 8,890,779 B2
(45) Date of Patent: Nov. 18, 2014

(54) ORGANIC LIGHT EMITTING DISPLAY FOR VARYING THE VOLTAGES OF THE CATHODE ELECTRODES BASED ON THE MAGNITUDE OF THE SIGNAL DATA AND DRIVING METHOD THEREOF

(75) Inventors: Duk-Jin Lee, Yongin (KR); Soon-Ryong Park, Yongin (KR); Woo-Suk Jung, Yongin (KR); Min-Jae Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 653 days.

(21) Appl. No.: 12/834,824

(22) Filed: Jul. 12, 2010

(65) Prior Publication Data

US 2011/0115830 A1 May 19, 2011

(30) Foreign Application Priority Data

Nov. 17, 2009 (KR) ..... 10-2009-0110785

(51) Int. Cl.
*G09G 3/30* (2006.01)
*G09G 3/32* (2006.01)

(52) U.S. Cl.
CPC ..... *G09G 3/3233* (2013.01); *G09G 2360/16* (2013.01); *G09G 2320/0285* (2013.01)
USPC ..... 345/77

(58) Field of Classification Search
CPC ..... G09G 2320/043
USPC ..... 345/77
See application file for complete search history.

(56) References Cited

U.S. PATENT DOCUMENTS

| | | | | |
|---|---|---|---|---|
| 2002/0105279 | A1 * | 8/2002 | Kimura | 315/169.3 |
| 2007/0229411 | A1 * | 10/2007 | Choi | 345/76 |
| 2008/0246749 | A1 * | 10/2008 | Lee et al. | 345/207 |
| 2009/0109147 | A1 * | 4/2009 | Park et al. | 345/76 |

FOREIGN PATENT DOCUMENTS

| | | | | |
|---|---|---|---|---|
| JP | 2006-65148 | | 3/2006 | |
| JP | 2006-091681 | | 4/2006 | |
| KR | 10-2006-0014213 | A | 2/2006 | |
| KR | 1020070109030 | A | 11/2007 | |
| KR | 10-2009-0084444 | A | 8/2009 | |
| WO | WO 2007004155 | A2 * | 1/2007 | G09G 3/32 |

OTHER PUBLICATIONS

Korean Office Action dated Aug. 31, 2011 issued in Korean Priority Application No. 10-2009-0110785, 1 page.

* cited by examiner

*Primary Examiner* — Long D Pham
(74) *Attorney, Agent, or Firm* — Christie, Parker & Hale, LLP

(57) ABSTRACT

An organic light emitting display includes a display unit divided into a plurality of fields (regions), data and scan drivers, a power supply, and a driving voltage calculator. The display unit has a plurality of cathode electrodes corresponding to the respective fields, and is configured to display an image in response to data and scan signals. The data and scan drivers respectively supply the data and scan signals to the display unit. The power supply has a first output terminal for outputting a first power and a plurality of second output terminals for outputting a plurality of second powers to the plurality of cathode electrodes. The driving voltage calculator calculates the voltage of each of the second powers for a respective one of the cathode electrodes based on a magnitude of a respective one of the data signals.

15 Claims, 5 Drawing Sheets

ORGANIC LIGHT EMITTING DISPLAY FOR VARYING THE VOLTAGES OF THE CATHODE ELECTRODES BASED ON THE MAGNITUDE OF THE SIGNAL DATA AND DRIVING METHOD THEREOF

CROSS-REFERENCE TO RELATED APPLICATIONS

This application claims priority to and the benefit of Korean Patent Application No. 10-2009-0110785, filed in the Korean Intellectual Property Office on Nov. 17, 2009, the entire content of which is incorporated herein by reference.

BACKGROUND

1. Field

Aspects of embodiments according to the present invention relate to an organic light emitting display and a driving method thereof, and more particularly, to an organic light emitting display with reduced power consumption and a driving method thereof.

2. Description of the Related Art

Recently, various types of flat panel displays with reduced weight and volume compared to those of cathode ray tubes have been developed. The flat panel displays include a liquid crystal display, a field emission display, a plasma display panel, an organic light emitting display, and the like.

Among the flat panel displays, the organic light emitting display displays images using organic light emitting diodes (OLEDs), which emit light corresponding to amounts of current flowing to the OLEDs. The organic light emitting display has various desirable characteristics, such as an excellent color reproduction, a thin profile, and the like. Accordingly, its fields of application have been widely expanded to markets such as mobile phones, PDAs, MP3 players, and the like.

An OLED used in an organic light emitting display includes an anode electrode, a cathode electrode, and a light emitting layer formed therebetween. When current flows from the anode electrode to the cathode electrode, the OLED emits light from the light emitting layer. The amount of emitted light varies according to the amount of current to display various luminance levels.

SUMMARY

In one embodiment of the present invention, there are provided an organic light emitting display capable of reducing power consumption, and a driving method thereof.

In an exemplary embodiment according to the present invention, an organic light emitting display is provided. The organic light emitting display includes a display unit, a data driver, a scan driver, a power supply, and a driving voltage calculator. The display unit is divided into a plurality of fields and includes a plurality of cathode electrodes corresponding to respective ones of the fields. The display unit is configured to display an image in response to data signals and scan signals. The data driver is configured to generate the data signals from image signals, and to supply the generated data signals to the display unit. The scan driver is for supplying the scan signals to the display unit. The power supply includes a first output terminal and a plurality of second output terminals. The first output terminal is for outputting a first power. The plurality of second output terminals is for outputting a plurality of second powers to the plurality of cathode electrodes. The driving voltage calculator is for calculating a voltage of each of the second powers for a respective one of the cathode electrodes based on a magnitude of a respective one of the data signals.

The driving voltage calculator may calculate the magnitude of the respective one of the data signals by using the image signals.

The driving voltage calculator may include a signal sensor, a current estimator, an operator, and a voltage controller. The signal sensor is for sensing a brightest image signal for each of the fields from among the image signals inputted in one frame. The current estimator is for estimating the magnitude of the respective one of the data signals generated by the brightest image signal by using the brightest image signal and a gamma correction value. The operator is for calculating the voltage of each of the second powers corresponding to the magnitude of the respective one of the data signals estimated by the current estimator. The voltage controller is for controlling the second output terminals so that the voltage of each of the second powers calculated by the operator is outputted through a respective one of the second output terminals.

The signal sensor may sense the brightest image signal of each of red, green, and blue image signals from among the image signals.

The operator may include a lookup table for storing the voltage of each of the second powers corresponding to the magnitude of the respective one of the data signals estimated by the current estimator.

The organic light emitting display may further include a gamma corrector configured to generate the gamma correction value.

The voltage of each of the second powers and the magnitude of the respective one of the data signals may be inversely related.

The power supply may include a variable resistor coupled to each of the second output terminals. The voltage of each of the second powers output through a respective one of the second output terminals may be controlled by controlling the variable resistor corresponding to the respective one of the second output terminals.

The organic light emitting display may further include a gamma corrector configured to generate a gamma correction value from the image signals and to output the gamma correction value to the data driver and the driving voltage calculator.

In another exemplary embodiment according to the present invention, a driving method of an organic light emitting display is provided. The driving method includes dividing image signals input in one frame into a plurality of fields, sensing a brightest image signal for each of the fields from among the image signals, determining a voltage of a driving power for each of the fields by using the brightest image signal, and outputting the driving power having the determined voltage through an output terminal to supply to a display unit.

The display unit may be driven by receiving a first power and a second power that is a voltage lower than that of the first power. The driving power may be the second power.

The sensing the brightest image signal may include sensing the brightest image signal of each of red, green, and blue images signals from among the image signals.

The outputting the driving power with the determined voltage may include controlling a variable resistor coupled to the output terminal.

The determining the voltage of the driving power may include applying a gamma correction value to the brightest image signal.

The determining the voltage of the driving power may further include using a lookup table for storing the voltage of the driving power corresponding to a value obtained by applying the gamma correction value to the brightest image signal.

In an organic light emitting display and a driving method thereof according to embodiments of the present invention, the voltage of a driving power is controlled based on the amount of current flowing to the pixels, thereby reducing power consumption. Particularly, in the case of a motion picture, the number of frames displayed at the maximum gray level is relatively few, and therefore, the power consumption can be significantly reduced.

BRIEF DESCRIPTION OF THE DRAWINGS

The accompanying drawings, together with the specification, illustrate exemplary embodiments of the present invention and, together with the description, serve to explain the principles of aspects of the present invention.

DETAILED DESCRIPTION

Figure 1:
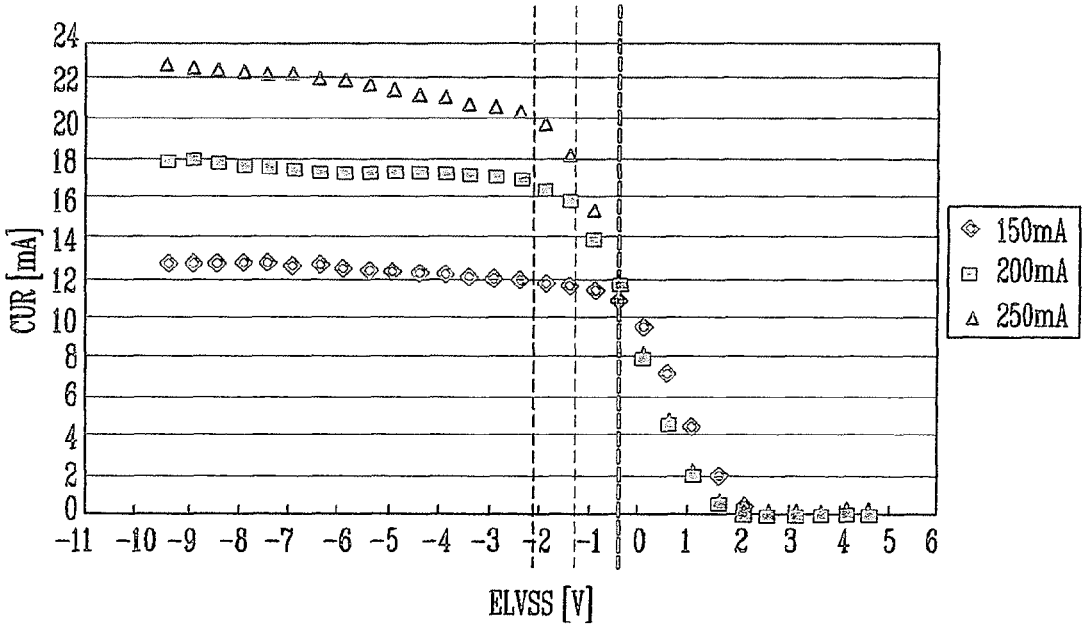
FIG. 1 is a graph illustrating changes in saturation points according to changes in the amount of current flowing to an organic light emitting diode of an organic light emitting display.

Hereinafter, certain exemplary embodiments according to the present invention will be described with reference to the accompanying drawings. Here, when a first element is described as being coupled to a second element, the first element may be directly coupled to the second element or indirectly coupled to the second element via a third element. Further, some of the elements that are not essential to a complete understanding of the invention are omitted for clarity. Also, like reference numerals refer to like elements throughout.

FIG. 1 is a graph illustrating changes in saturation points according to changes in the amount of current flowing to the OLED. An ordinate (horizontal axis) of the graph indicates the voltage of a ground power source coupled to the cathode electrode of the OLED, and an abscissa (vertical axis) of the graph indicates the amount of current flowing from the anode electrode to the cathode electrode in the OLED. Three different sets of results are shown in FIG. 1 (see legend), corresponding to three different saturation currents: 150 mA, 200 mA, and 250 mA.

Referring to FIG. 1, when the saturation current is 150 mA, the cathode electrode in a saturation region has a voltage of 0V to −1V. When the saturation current is 200 mA, the cathode electrode in a saturation region has a voltage of −1V to −2V. When the saturation current is 250 mA, the cathode electrode in a saturation region has a voltage lower than −2V.

That is, the voltage of the cathode electrode varies according to the amount of the saturation current. Therefore, the OLED is designed to emit light using a portion of the current corresponding to the saturation current.

However, in an organic light emitting display, the voltage of the cathode electrode of an OLED is generally set to a voltage corresponding to where the saturation current is the largest. That is, although normally only a few images among all of the images displayed in the organic light emitting display are displayed at the highest gray level (i.e., the brightest), the voltage of the cathode electrode is set to a voltage corresponding to the case where the saturation current is the largest. Therefore, a driving voltage might be higher than necessary, which might cause an increase of power consumption.

Figure 2:
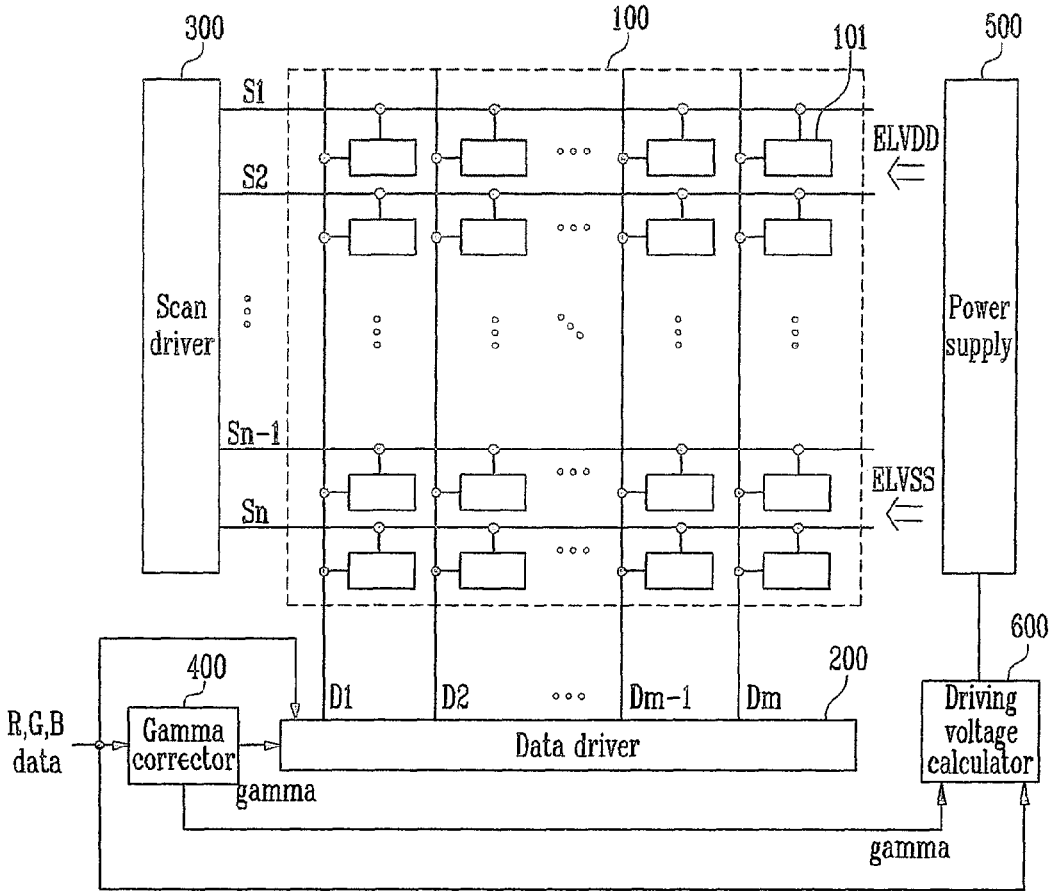
FIG. 2 is a block diagram illustrating the structure of an organic light emitting display device according to an embodiment of the present invention.

FIG. 2 is a block diagram illustrating the structure of an organic light emitting display device according to an embodiment of the present invention.

Referring to FIG. 2, the organic light emitting display includes a display unit 100, a data driver 200, a scan driver 300, a gamma corrector 400, a power supply 500, and a driving voltage calculator 600.

A plurality of pixels 101 are arranged in the display unit 100, and each of the pixels 101 includes an organic light emitting diode (OLED, not shown) that emits light in response to a flow of current. In the display unit 100, n scan lines S1, S2, . . . , Sn−1, and Sn and m data lines D1, D2, . . . , Dm−1, and Dm are arranged. Here, the n scan lines S1, S2, . . . , Sn−1, and Sn are arranged in rows to supply scan signals, and the m data lines D1, D2, . . . , Dm−1, and Dm are arranged in columns to supply data signals.

The display unit 100 is driven by receiving a first power ELVDD and a plurality of second powers ELVSS, supplied from the power supply 500. Thus, when current flows to the OLEDs because of the scan signals, the data signals, the first power ELVDD, and the second powers ELVSS, the display unit 100 emits light according to the amount of current flowing to the OLEDs, thereby displaying an image. The first power ELVDD is supplied to anode electrodes of the organic light emitting diodes, and the second powers ELVSS are supplied to cathode electrodes of the organic light emitting diodes. The voltages of the second powers ELVSS may be lower than that of the first power ELVDD. In one embodiment, each of the OLEDs has a separate anode, but multiple OLEDs share a same one of the cathodes.

The data driver 200 generates data signals by applying gamma correction values gamma and the like to image signals R,G,B data having red, blue, and green components. The data driver 200 is coupled to the data lines D1, D2, . . . , Dm−1, and Dm in the display unit 100 to supply the generated data signals to the display unit 100.

The scan driver 300 generates scan signals, and is coupled to the scan lines S1, S2, . . . , Sn−1, and Sn to supply scan signals to specific rows. The data signals output from the data driver 200 are supplied to pixels 101 having the scan signal supplied thereto, and driving currents are generated in the pixels 101. Thus, the generated driving currents flow to the OLEDS in the pixels 101.

The gamma corrector 400 supplies gamma correction values (gamma) to the data driver 200 to correct image signals. When display devices display images by directly processing the input image signals according to their luminance magnitudes, the desired luminance might not be produced. In order to solve such a problem, luminance is controlled according to each gray level. Such a correction is referred to as a gamma correction. The gamma correction unit 400 also supplies the gamma correction values gamma to the driving voltage calculation unit 600.

The power supply 500 generates and supplies driving voltages to the display unit 100, the data driver 200, the scan driver 300, and the like. The first power ELVDD and the second powers ELVSS correspond to the driving power supplied to the display unit 100. Voltage levels of the second powers ELVSS are adjusted as determined and supplied to the display unit 100 to reduce power consumption based on the image signals R,G,B data currently being displayed. The second powers ELVSS are output through a plurality of output terminals corresponding to different portions of the display unit 100, and the voltage levels of the second powers ELVSS output through each of the output terminals are controlled.

The driving voltage calculator 600 determines the voltage of each of the second powers ELVSS using image signals R,G,B data that are also supplied to the data driver 200. More specifically, one frame is divided into a plurality of (physical or spatial) fields, with each field representing the corresponding image signals for a portion (region) of the display unit 100 that receives its own second power ELVSS (for example, each portion may correspond to a separate cathode electrode in the display unit 100). The driving voltage calculator 600 calculates the maximum amount of current flowing to each of the pixels 101 in each of the fields by using red, green, and blue image signals input in each of the fields and gamma correction values gamma. The maximum amount of current is then calculated by determining the amount of current flowing to the pixel that emits light with the maximum luminance in each of the fields. The driving voltage calculator 600 calculates the amount of current determined as described above for each field of each frame.

Thus, the driving power of the organic light emitting display is controlled, so that power consumption can be reduced. Since in a typical motion picture, the number of frames displayed at the maximum gray level is relatively few, the power consumption can be significantly reduced.

Figure 3:
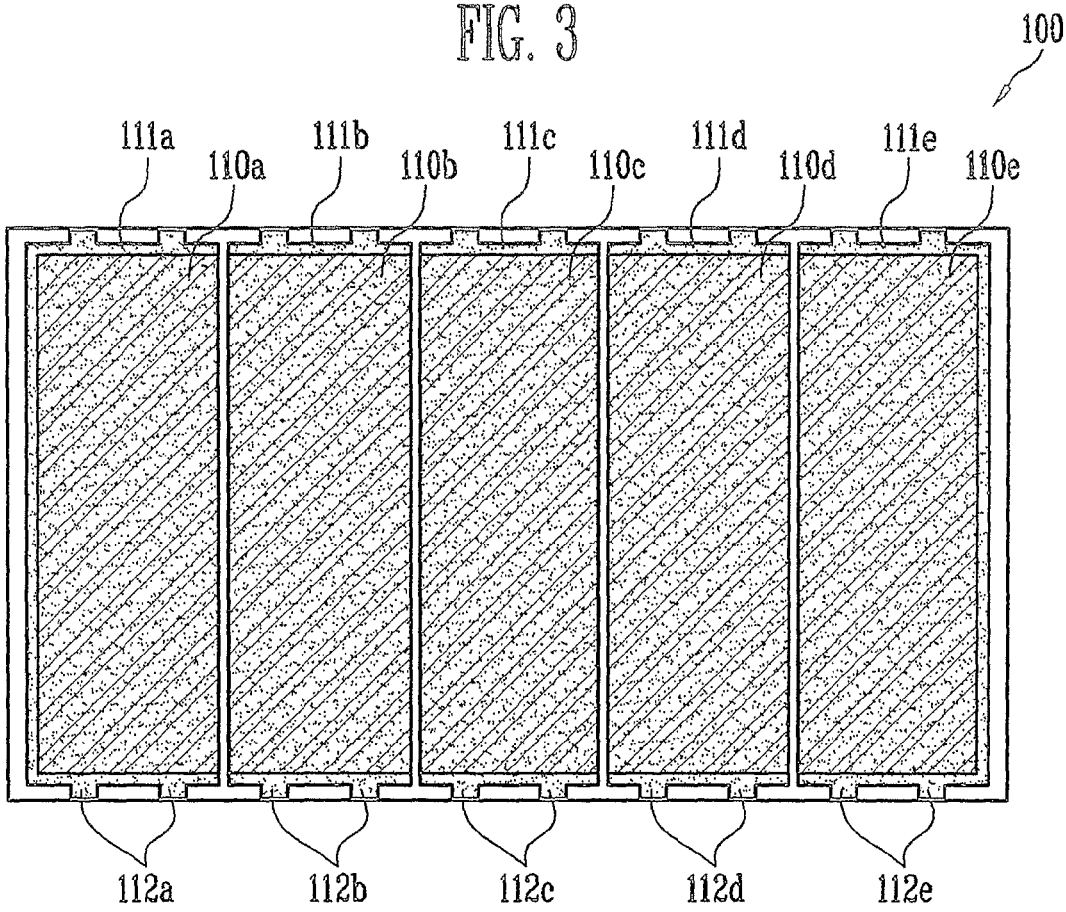
FIG. 3 is a view illustrating the structure of cathode electrodes in a display unit illustrated in FIG. 2.

FIG. 3 is a view illustrating the structure of cathode electrodes in the display unit illustrated in FIG. 2.

Referring to FIG. 3, a plurality of cathode electrodes 110*a*, 110*b*, 110*c*, 110*d*, and 110*e* are located on the entire surface of the display unit 100. For convenience of illustration, the cathode electrodes 110*a*, 110*b*, 110*c*, 110*d*, and 110*e* are formed in a 1×5 arrangement on the entire surface of the display unit 100. A plurality of second power interconnections 111*a*, 111*b*, 111*c*, 111*d*, and 111*e* (shown at the top and bottom of the display unit 100 in FIG. 3) are located on the cathode electrodes 110*a*, 110*b*, 110*c*, 110*d*, and 110*e*. Power source pads 112*a*, 112*b*, 112*c*, 112*d*, and 112*e* (shown at the top and bottom of the display unit 100 in FIG. 3) are located at the plurality of second power interconnections 111*a*, 111*b*, 111*c*, 111*d*, and 111*e*, respectively. Each of the power source pads 112*a*, 112*b*, 112*c*, 112*d*, and 112*e* is coupled to the power supply 500 to receive the corresponding second power ELVSS supplied from the power supply 500.

The plurality of cathode electrodes 110*a*, 110*b*, 110*c*, 110*d*, and 110*e* is electrically coupled to the second power interconnections 111*a*, 111*b*, 111*c*, 111*d*, and 111*e* to supply second powers ELVSS to the cathode electrodes 110*a*, 110*b*, 110*c*, 110*d*, and 110*e*, respectively. Thus, the power supply 500 generates a plurality of second powers ELVSS, and the generated second powers ELVSS are independently controlled. Hence, the different voltages of the second powers ELVSS supplied to the display unit 100 can be supplied to the plurality of cathode electrodes 110*a*, 110*b*, 110*c*, 110*d*, and 110*e*, respectively. The number of fields (regions) may be different in other embodiments.

Figure 4:
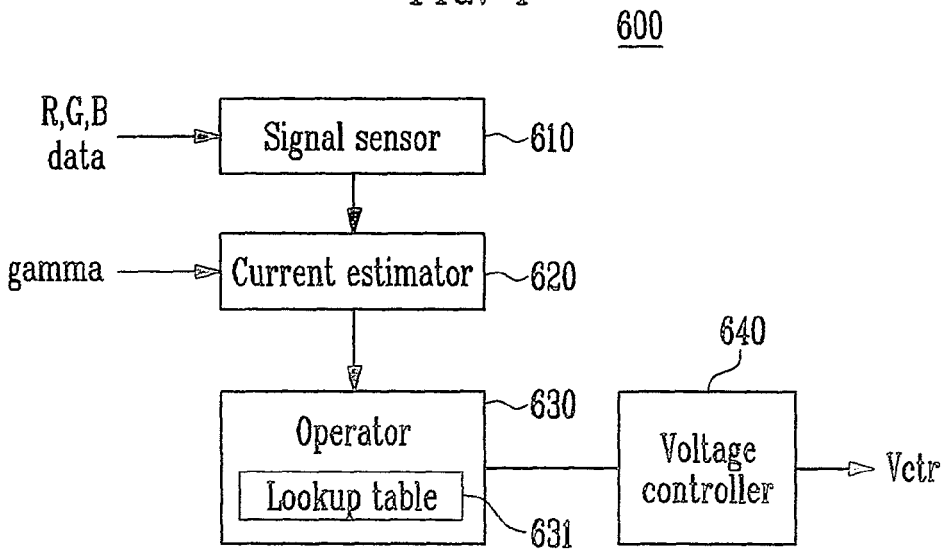
FIG. 4 is a block diagram illustrating the structure of a driving voltage calculator used in the organic light emitting display illustrated in FIG. 2.

FIG. 4 is a block diagram illustrating the structure of the driving voltage calculator used in the organic light emitting display illustrated in FIG. 2. Referring to FIG. 4, the driving voltage calculator 600 includes a signal sensor 610, a current estimator 620, an operator 630, and a voltage controller 640.

The signal sensor 610 senses the maximum red, green, and blue image signals among red, green, and blue image signals R,G,B data inputted in one frame. In particular, the signal sensor 610 senses the maximum image signals respectively inputted to regions (fields) divided by the cathode electrodes of the display unit 100 for each frame. Here, the maximum image signal refers to the brightest image signal, i.e., an image signal with the highest gray level.

The current estimator 620 estimates the maximum amount of current flowing to the pixels by using the maximum red, green, and blue image signals sensed by the signal sensor 610 and the gamma correction values gamma.

The operator 630 calculates the voltage of a driving power by using the maximum amount of current estimated by the current estimator 620. The operator 630 includes a lookup table 631, and the lookup table 631 stores the voltages of a driving power corresponding to different maximum amounts of current estimated to drive the display. If the amount of current is large, the operator 630 allows the voltage of the driving power to be decreased. If the amount of current is small, the operator 630 allows the voltage of the driving power to be increased. That is, in some embodiments, the maximum amounts of current estimated and the corresponding voltages of the driving power are inversely related.

The voltage controller 640 outputs a voltage control signal Vctr corresponding to the voltages of the driving power calculated by the operator 630. The voltage control signal Vctr controls the voltages of the second powers ELVSS of the first and second powers ELVDD and ELVSS that are driving powers output from the power supply 500. That is, the voltage controller 640 controls the second powers ELVSS output from the power supply 500. Here, each of the second powers ELVSS has a voltage suitable for the amount of current in pixels using the maximum amount of current for its respective field (region) in one frame.

Figure 5:
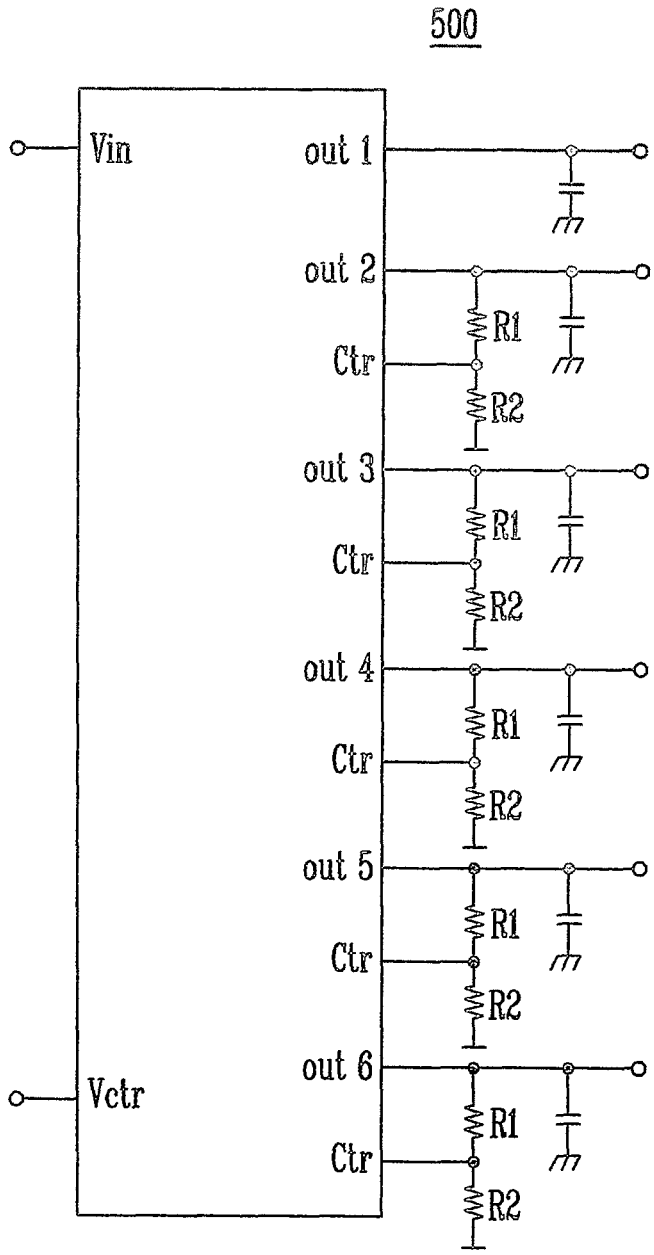
FIG. 5 is a circuit diagram illustrating an embodiment of a power supply used in the organic light emitting display illustrated in FIG. 2.

FIG. 5 is a circuit diagram illustrating an embodiment of a power supply used in the organic light emitting display illustrated in FIG. 2.

Referring to FIG. 5, the power supply 500 receives an input voltage Vin and a voltage control signal Vctr outputted from the voltage controller 640 and outputs power through first to sixth output terminals out1 to out6. The number of output terminals in other embodiments may be different, and may differ from the number of regions or the number of first and second powers ELVDD and ELVSS. The power output through the first output terminal out1 is the first power ELVDD, and the powers output through the second to sixth output terminals out2 to out6 are second powers ELVSS. Each of the second to sixth output terminals out2 to out6 is coupled to a variable resistor (shown in FIG. 5 as first and second resistors R1 and R2), and the variable resistor is coupled to a voltage control terminal Ctr. The resistance ratio of the first and second resistors R1 and R2 is controlled by an output signal outputted through the voltage control terminal Ctr, thereby controlling the voltage of each of the second powers ELVSS outputted through the second to sixth output terminals out2 to out6.

Figure 6:
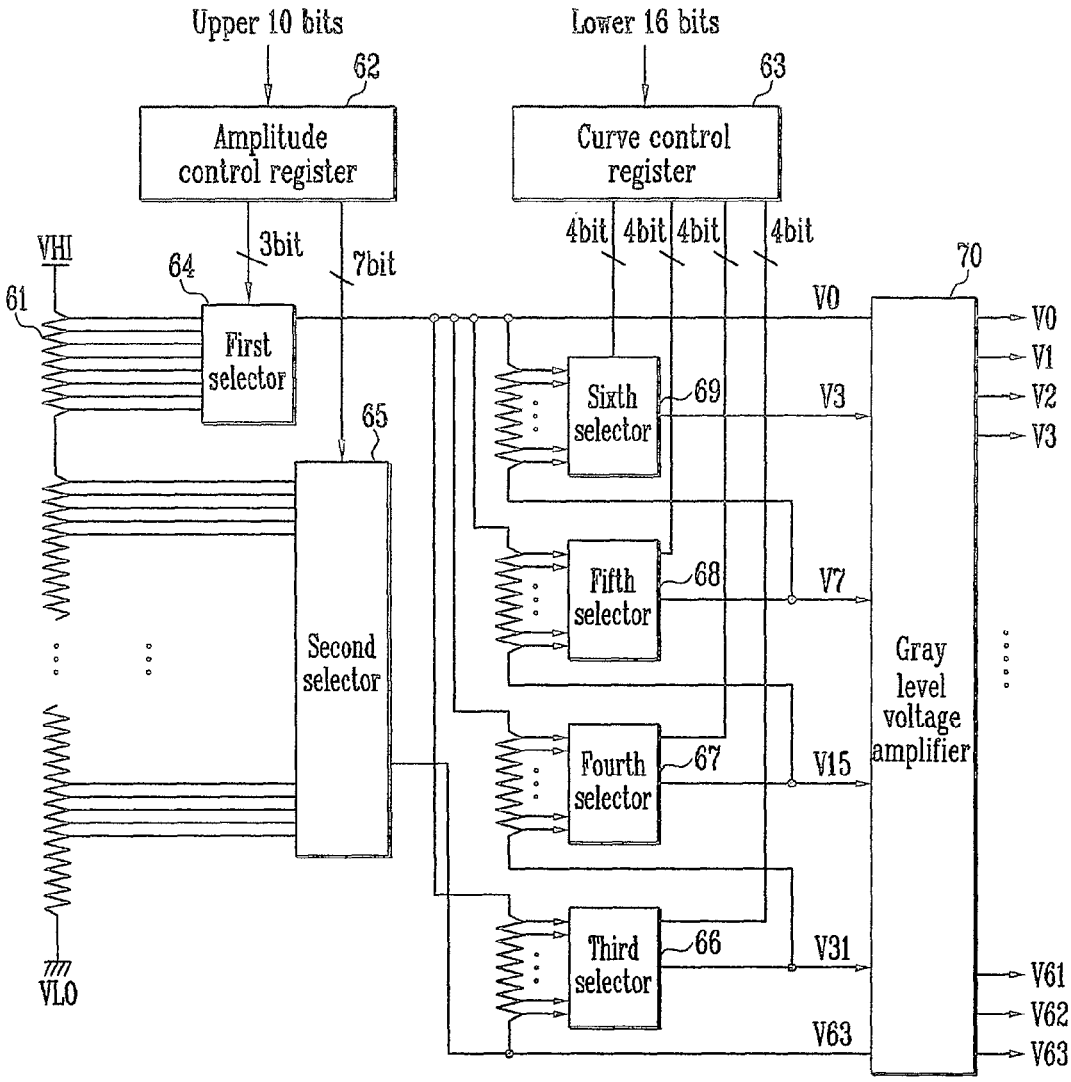
FIG. 6 is a block diagram illustrating an embodiment of a gamma correcting component used in the data driver of the organic light emitting display illustrated in FIG. 2.

FIG. 6 is a block diagram illustrating an embodiment of a gamma correcting component used in the data driver 200 of the organic light emitting display illustrated in FIG. 2. Referring to FIG. 6, the gamma correcting component includes a ladder resistor 61, an amplitude (magnitude) control register 62, a (gamma) curve control register 63, first to sixth selectors 64 to 69, and a gray level voltage amplifier 70. In other embodiments, the gamma correction portion may be in a separate component or part of the gamma corrector 400.

The ladder resistor 61 determines the uppermost level voltage VHI as a reference voltage. The ladder resistor 61 has a configuration in which a plurality of variable resistors included between the lowermost level voltage VLO and the reference voltage VHI are coupled to one another in series. A plurality of gray level voltages are generated through the ladder resistor 61. As the resistance of the ladder resistor 61 is decreased, the amplitude control range is narrowed, but the control precision is improved. On the other hand, as the resistance of the ladder resistor 61 is increased, the amplitude control range is broadened, but the control precision is lowered.

In the exemplary gamma correcting component embodiment depicted in FIG. 6, the amplitude control register 62 outputs a first register setting value of 3 bits to the first selector 64 and outputs a second register setting value of 7 bits to the second selector 65. It should be noted that the number of gray levels to be selected may be increased by increasing the number of first and second register setting bits, and different gray level voltages may be selected by changing the first and second register setting values.

Continuing with the embodiment of FIG. 6, the gamma curve control register 63 outputs third to sixth register setting values of 4 bits each to the third to sixth selectors 66 to 69, respectively. By changing the third to sixth register setting values, the voltages selected based on the register setting values may be controlled.

In the embodiment of FIG. 6, the gamma correction value gamma (from FIG. 2) has a signal of 26 bits, and upper 10 bits and lower 16 bits are inputted to the magnitude control register 62 and the gamma curve control register 63, respectively. Thus, the gamma correction value selects the first to sixth register setting values. In other embodiments, the gamma correction value may have a different number of bits.

The first selector 64 selects a first gray level voltage corresponding to the first register setting value of 3 bits outputted from the magnitude control register 62, from among the plurality of gray level voltages distributed through the ladder resistor 61, and outputs the first gray level voltage as an uppermost gray level voltage.

The second selector 65 selects a second gray level voltage corresponding to the register setting value of 7 bits outputted from the magnitude control register 62, from among the plurality of gray level voltages distributed through the ladder resistor 61, and outputs the second gray level voltage as a lowermost gray level voltage.

The third selector 66 distributes a voltage range between the first and second gray level voltages respectively outputted from the first and second selectors 64 and 65 as a plurality of gray level voltages through a line of resistors. Then, the third selector 66 selects a third gray level voltage corresponding to the third register setting value of 4 bits and outputs the selected third gray level voltage.

The fourth selector 67 distributes a voltage range between the first and third gray level voltages respectively outputted from the first and third selectors 64 and 66 as a plurality of gray level voltages through a line of resistors. Then, the fourth selector 67 selects a fourth gray level voltage corresponding to the fourth register setting value of 4 bits and outputs the selected fourth gray level voltage.

In similar fashion, the fifth selector 68 selects a fifth gray level voltage corresponding to the fifth register setting value of 4 bits among a plurality of gray level voltages between the first and fourth gray level voltages output from the first and fourth selectors 64 and 67 and outputs the selected fifth gray level voltage. Likewise, the sixth selector 69 selects a sixth gray level voltage corresponding to the sixth register setting value of 4 bits among a plurality of gray level voltages between the first and fifth gray level voltages output from the first and fifth selectors 64 and 68 and outputs the selected sixth gray level voltage.

As described above, the gamma curve of an intermediate gray level unit is controlled based on the register setting value of the gamma curve control register 63, so that gamma properties can be easily controlled suitable for properties of light emitting devices. When the gamma curve property is controlled to be downwardly bulged, the resistance of each of the variable resistors in the ladder resistor 61 is set so that the potential difference between gray levels is increased as a low gray level is displayed. On the other hand, when the gamma curve property is controlled to be upwardly bulged, the resistance of each of the variable resistors in the ladder resistor 61 is set so that the potential difference between gray levels is decreased as a low gray level is displayed.

As depicted in FIG. 6, the exemplary gray level voltage amplifier 70 outputs a plurality of gray level voltages V0, V1, . . . , V63 respectively corresponding to a plurality of gray levels to be displayed on the display unit 100.

The aforementioned operations are performed by providing a gamma correction circuit for each R,G,B group so that the red, green, and blue have almost identical luminance properties, considering the variation in property of each R,G,B light emitting device. Accordingly, the amplitudes (magnitudes) and gamma curves of red, green, and blue can be set to be different from one another through the amplitude control register 62 and the gamma curve control register 63.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

a display unit spatially divided into a plurality of shared cathode electrodes each shared as a cathode electrode by each of a different plurality of organic light emitting diodes and configured to receive a respective one of a corresponding plurality of different second powers from a respective one of a corresponding plurality of second output terminals, the display unit being configured to display an image in response to data signals and scan signals;

a data driver configured to generate the data signals from image signals, and to supply the generated data signals to the display unit;

a scan driver for supplying the scan signals to the display unit;

a power supply comprising a first output terminal for outputting a first power to the display unit, and the plurality of second output terminals for concurrently outputting respective ones of the corresponding plurality of different second powers to respective ones of the shared cathode electrodes; and a driving voltage calculator for calculating respective different voltages of the corresponding plurality of different second powers for the respective ones of the shared cathode electrodes based on magnitudes of respective ones of the data signals.

2. The organic light emitting display according to claim 1, wherein the driving voltage calculator is configured to calculate the magnitudes of the respective ones of the data signals by using the image signals.

3. The organic light emitting display according to claim 1, wherein the driving voltage calculator comprises:

a signal sensor for sensing a brightest image signal for each of the shared cathode electrodes from among the image signals inputted in one frame;

a current estimator for estimating the magnitudes of the respective ones of the data signals generated by the brightest image signal by using the brightest image signal and a gamma correction value;

an operator for calculating the respective different voltages of the corresponding plurality of different second powers corresponding to the magnitudes of the respective ones of the data signals estimated by the current estimator; and a voltage controller for controlling the second output terminals so that the respective different voltages of the corresponding plurality of different second powers calculated by the operator are outputted through respective ones of the corresponding plurality of second output terminals.

4. The organic light emitting display according to claim 3, wherein the signal sensor senses the brightest image signal of each of red, green, and blue image signals from among the image signals.

5. The organic light emitting display according to claim 3, wherein the operator comprises a lookup table for storing the respective different voltages of the corresponding plurality of different second powers corresponding to the magnitudes of the respective ones of the data signals estimated by the current estimator.

6. The organic light emitting display according to claim 3, further comprising a gamma corrector configured to generate the gamma correction value.

7. The organic light emitting display according to claim 1, wherein the respective different voltages of the corresponding plurality of different second powers and respective ones of the magnitudes of the respective ones of the data signals are inversely related.

8. The organic light emitting display according to claim 1, wherein the power supply further comprises a corresponding plurality of variable resistors coupled to respective ones of the corresponding plurality of second output terminals, and the respective different voltages of the corresponding plurality of different second powers concurrently output through the respective ones of the corresponding plurality of second output terminals is controlled by controlling respective ones of the corresponding plurality of variable resistors corresponding to the respective ones of the corresponding plurality of second output terminals.

9. The organic light emitting display according to claim 1, further comprising a gamma corrector configured to generate a gamma correction value from the image signals and to output the gamma correction value to the data driver and the driving voltage calculator.

10. A driving method of an organic light emitting display, comprising:

dividing image signals input in one frame into a plurality of fields each corresponding to a respective one of a corresponding plurality of shared cathode electrodes that spatially divide a display unit of the organic light emitting display and receive respective ones of a corresponding plurality of different second powers, each of the plurality of shared cathode electrodes being shared as a cathode electrode by each of a different plurality of organic light emitting diodes;

driving the display unit with a first power supplied to a first output terminal and the corresponding plurality of different second powers being concurrently supplied to respective ones of the shared cathode electrodes;

sensing a brightest image signal for each of the fields from among the image signals;

determining respective different voltages of the corresponding plurality of different second powers for respective ones of the fields by using the brightest image signal; and concurrently outputting respective ones of the corresponding plurality of different second powers having the respective different voltages through respective ones of a corresponding plurality of second output terminals to supply to the display unit.

11. The driving method according to claim 10, wherein the display unit is driven by receiving the first power and the corresponding plurality of different second powers that are different voltages lower than that of the first power.

12. The driving method according to claim 10, wherein the sensing the brightest image signal comprises sensing the brightest image signal of each of red, green, and blue images signals from among the image signals.

13. The driving method according to claim 10, wherein the concurrently outputting of the respective ones of the corresponding plurality of different second powers with the determined respective different voltages comprises controlling a corresponding plurality of variable resistors coupled to respective ones of the corresponding plurality of second output terminals.

14. The driving method according to claim 10, wherein the determining of the respective different voltages of the corresponding plurality of different second powers comprises applying a gamma correction value to the brightest image signal.

15. The driving method according to claim 14, wherein the determining of the respective different voltages of the corresponding plurality of different second powers further comprises using a lookup table for storing the respective different voltages of the corresponding plurality of different second powers corresponding to values obtained by applying the gamma correction value to the brightest image signal.

* * * * *